US005590472A

United States Patent [19]

Yaakov

[11] Patent Number: 5,590,472

[45] Date of Patent: Jan. 7, 1997

[54] CUTLERY WHICH DOES NOT SOIL AND A METHOD FOR ITS PRODUCTION

[76] Inventor: Greenvurcel Yaakov, 28, Houtzot Hayotzer, Jerusalem 94117, Israel

[21] Appl. No.: 404,821

[22] Filed: Mar. 14, 1995

[30] Foreign Application Priority Data

Mar. 14, 1994 [IL] Israel ..... 108973

[51] Int. Cl.[6] ..... A47J 43/28

[52] U.S. Cl. ..... 30/323; 30/298.4; 30/327

[58] Field of Search ..... 30/142, 147–150, 30/298.4, 323, 327; 76/104.1

[56] References Cited

U.S. PATENT DOCUMENTS

| | | | |
|---|---|---|---|
| 1,528,679 | 3/1925 | MacLeod | 30/323 X |
| 1,771,296 | 7/1930 | Harley et al. | 30/149 X |
| 2,216,005 | 9/1940 | Goldstein | 30/150 X |
| 2,789,349 | 4/1957 | Lee | 30/323 X |
| 3,858,320 | 1/1975 | Neal et al. | 30/326 X |
| 4,524,512 | 6/1985 | Formo et al. | 30/150 X |
| 4,995,154 | 2/1991 | Bamber | 30/148 X |

*Primary Examiner*—Douglas D. Watts
*Attorney, Agent, or Firm*—Lowe, Price, LeBlanc & Becker

[57] ABSTRACT

Cutlery in the form of a knife, fork or spoon is formed with a supporting foot at a center portion thereof that elevates the working portion above a support surface when the cutlery is placed on the surface. A method of manufacturing cutlery according to the aforementioned invention is also disclosed.

8 Claims, 5 Drawing Sheets

CUTLERY WHICH DOES NOT SOIL AND A METHOD FOR ITS PRODUCTION

FIELD OF THE INVENTION

The present invention relates to knives, soup spoons, tea spoons, forks, and similar table cutlery used for eating, and a method for their production.

More specifically, the invention relates to cutlery which doesn't soil the table, after having had contact with food, and have been replaced on the table.

BACKGROUND OF THE INVENTION

When eating with cutlery such as a knife, fork, soup spoon, and tea spoon there is a problem when putting them on the table, since they soil the table when it comes in contact with the part that has contacted the food. An additional problem which arises when stopping to eat is soiling the cutlery from filth on the table, after having put them down, thus preventing their continued use. Therefor, in order to prevent this, many people lean their cutlery on the plate, or any other protruding dish on the table, when stopping to eat.

Different shaped stands are known today, intended for the leaning of the cutlery in such a way that the top edge of the cutlery (such as the knife blade or the fork prong) which has contacted food, does not touch the table, but remaines suspended in the air, and only the handle touches the table.

The present invention renders the stand unnecessary for the preservation of cleanliness of the table and the cutlery.

SUMMARY OF THE INVENTION

The present invention relates to cutlery with a supporting foot or nodule situated at the center of the tool, so that the part that comes in contact with the food is raised when placing the tool on the table or any other surface.

The cutlery may be a knife, fork, soup or tea spoon, wherein the part which is upraised off the table (the part being used), when placing the cutlery is the knife blade, the fork prong, or the soup or tea spoon concave.

The nodule or foot are situated approximately at the center of the cutlery but beyond it's center, so that, placing of cutlery on the table and leaning it on the foot or nodule, causes the handle to sink towards the table, and to leave the part in use in the air. The table only comes in contact with the nodule or foot, and the edge of the handle.

The present invention relates also to a method for the production of the cutlery, according to the invention.

Two cuts are produced in a flat raw material (the raw material from which cutlery is made, for example, any metal which is used in the cutlery industry). One cut is exterior, and determines the design of the handle of the cutlery. The other cut is internal and determines the purpose of the tool. As per example, the interior cut determines the shape of the fork prong, or the shape of the knife blade. (In the case of a soup and tea spoon the concave is created only after having performed the cuting and bending.)

The two cuts are performed in such a way that gives three different surfaces on top of the raw material. One will be the handle, the second will be the part in use, and the third will become the nodule or foot.

The handle surface is bent in relation to the surface of the used part around the bending line, in an angle of approximately 140°–180° , the third surface, near the bending line, approximately in the center of the tool remains in place, and becomes the foot or nodule.

DETAILED DESCRIPTION OF THE INVENTION

Figure 1:
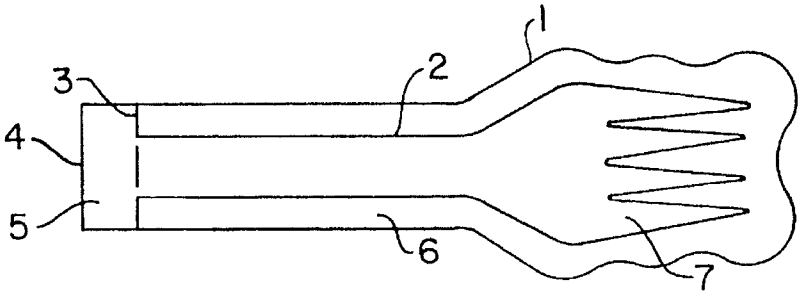
Figure 2:
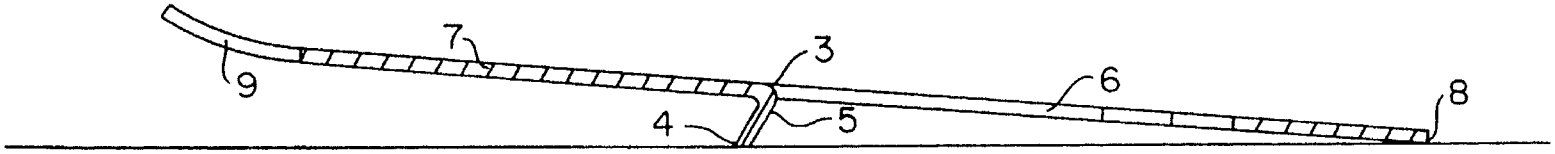
Figure 3:
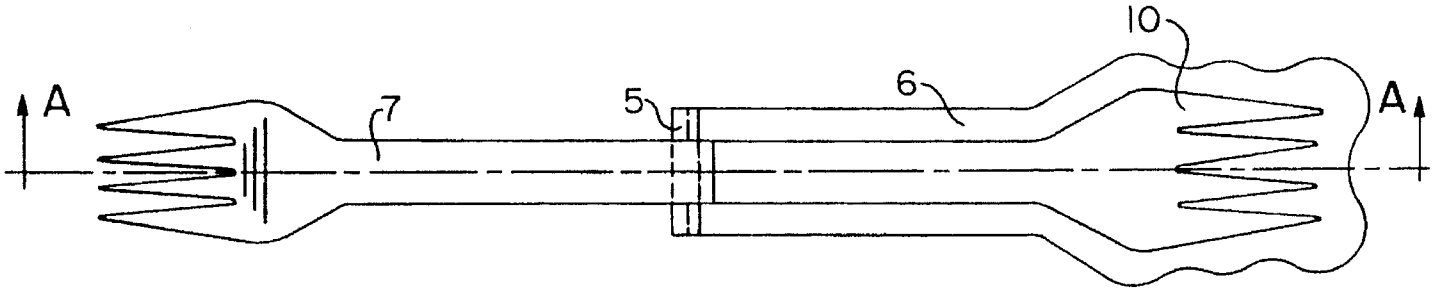

The invention will be further described in detail in FIGS. 1–9. These figures do not intend to limit the scope of the invention, and are meant for clarification and illustration of the invention only, the figures relate to the examples of a fork, and a soup and tea spoon, but are put to practice in a parallel way in knives, and other cutlery as well. Following is a brief description of the figures:

FIGS. 1–3 describe an example of a fork according to the invention, and a process for its reception.

FIG. 1 describes in over view the bending and folding lines, in the example of the fork.

FIG. 2 describes in side view the fork according to the received invention after bending the interior part in 180° in relation to the exterior part.

FIG. 3 describes in over view the fork according to the invention, described (in side view) in FIG. 2.

Figure 4:
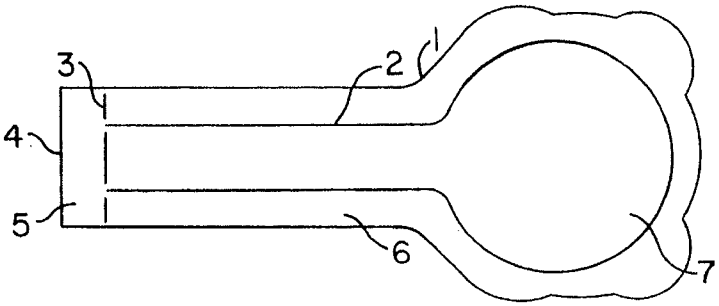
Figure 5:
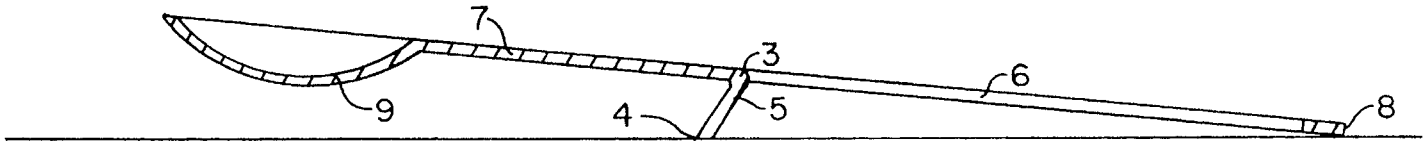
Figure 6:
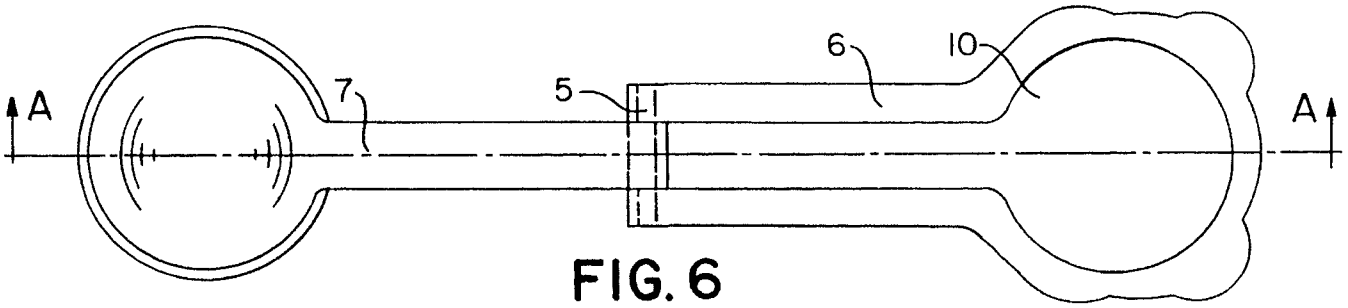

FIGS. 4–6 describe an example of a soup (or tea) spoon, according to the invention, and a process for its manufacture.

FIG. 4 describes in over view the bending and folding lines in the example of the spoon.

FIG. 5 describes in side view (section A—A) the spoon according to the invention, received after bending the interior part in 180° in relation to the exterior part.

FIG. 6 describes in over view the spoon according to the invention described (in side view) in FIG. 5.

Figure 7:
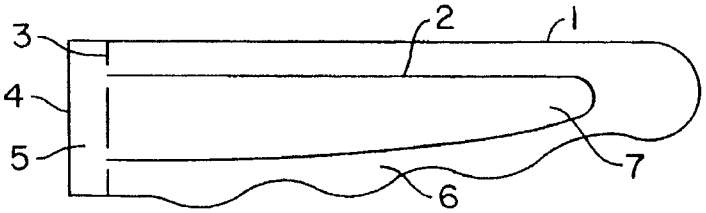
Figure 8:
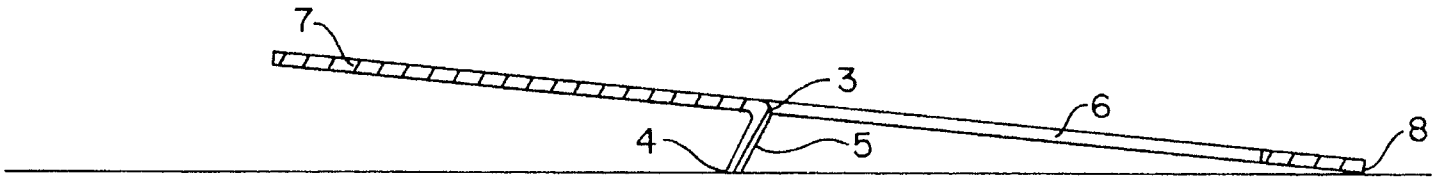
Figure 9:
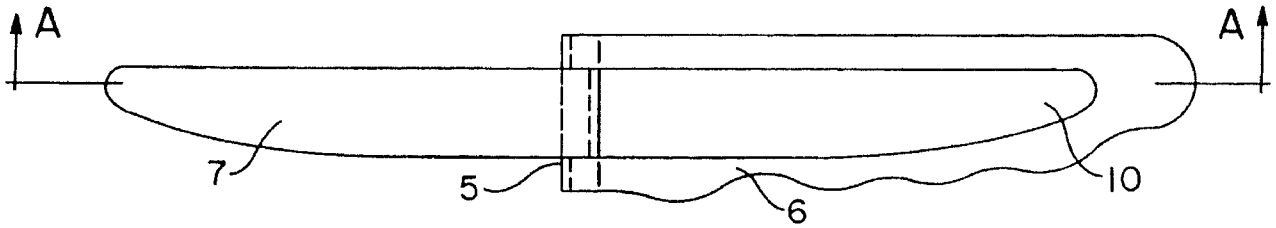

FIGS. 7–9 describe a knife according to the invention, and a process for its preparation.

FIG. 7 describes the bending and folding lines of the knife in over view.

FIG. 8 describes the knife in side view, according to the invention, received after bending the interior part 180° in rotation to the exterior part.

FIG. 9 describes in over view the knife according to the invention, described (in side view) in FIG. 8.

Figure 10:
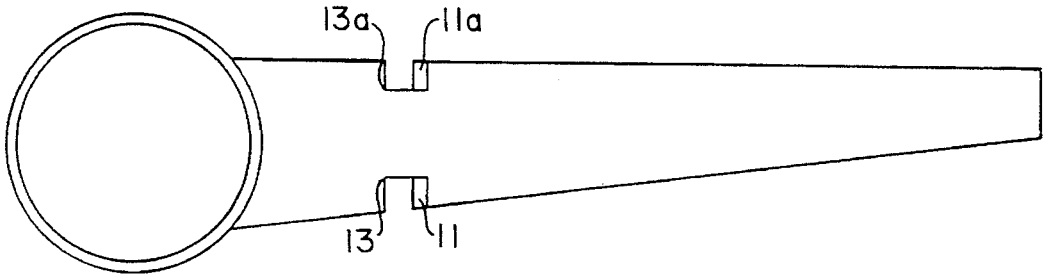

FIG. 10 describes in over view another variation of a spoon according to the invention, wherein two supporting legs are located on the handle margin in its upper part.

Figure 11:
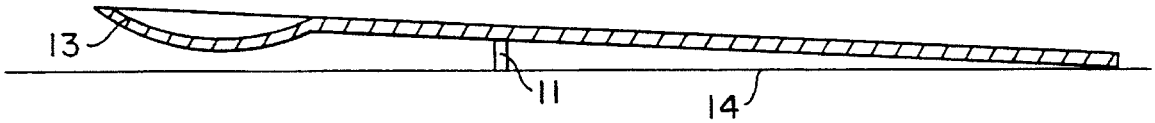

FIG. 11 describes in side view (cross section) the spoon in FIG. 10.

Figure 12:
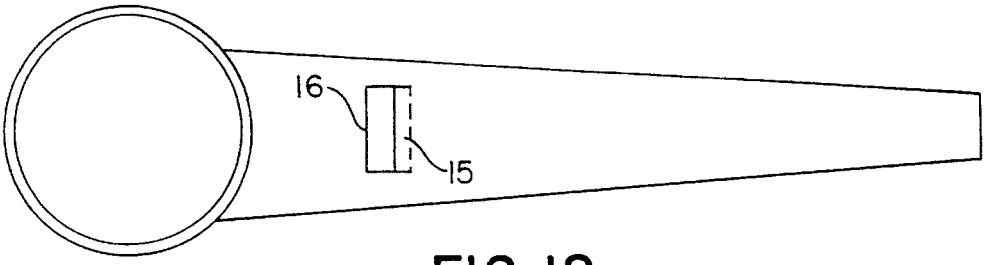

FIG. 12 describes in over view another variation of a spoon according to the invention, wherein the supporting leg is located in the center of the handle width in it's upper part.

Figure 13:
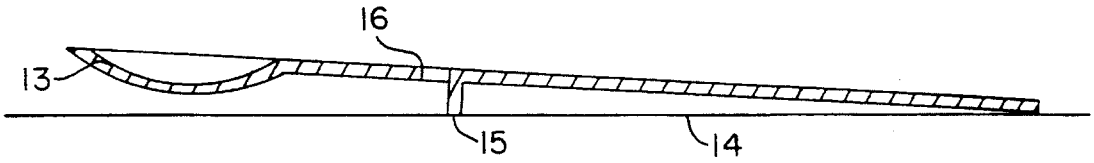

FIG. 13 describes in side view (cross section) the spoon in FIG. 12.

Following is a detailed description of the figures:

FIG. 1 describes in over view the cutting and bending lines in the example of a fork, on the material from which the fork is made. The surface of the material, can be any material accepted in the cutlery industry such as metal or nirosta. The cutting lines are an exterior cutting line (1) which will determine the shape of the holding handle, and and interior cutting line (2) which will define the use of the tool. The exterior cutting line can be designed in any required shape for a handle, aesthetically as well as functionally. The interior cutting line is designed according to the purpose (the shape of the knife blade, the fork prongs, and eliptical or round shape of the soup or tea spoon, etc.). The bending line (3) passes along the edge of the interior cutting line spacially, and defines a space for the line of the edge of the board (4). The surface created in the space (5) between the bending line (the interior cutting line (3)) and the edge of the board (4) will create the supporting foot or nodule of the fork.

FIG. 2 describes in side view the fork according to the invention received after bending of the interior surface (7) approximately in 180° in relation to the exterior surface (6). Between the two surfaces, a surface (5) protrudes upwards in the space between the bending line (3) and the original edge of the board (4). The center of the fork leans towards the handle, and thus the surface of the handle (6) sinks towards the table, and its edge (8) touches the surface of the table. On the other hand the interior surface (7), whose edge (9) is used for eating, rises upwards when the fork is placed on the table. The area of use (9) can be bent and designed according to necessity.

FIG. 3 describes in over view the fork described in FIG. 2 (in side view). The interior surface (7) was folded outwards and created an air space designed in its shape (fork shape) (10) surrounded by a surface of the exterior handle (6). Perpendicular to the two surfaces (6) and (7) downwards, protrudes the supporting foot (nodule) of the fork, which allows the surface to be used for eating (inserting into the mouth) to be over the table surface when placing the fork on the table.

FIG. 4 describes in over view the cutting and bending lines in the example of a soup (or tea) spoon on the material surface from which the spoon is made. The cutting lines are an exterior cutting line (1) which will later determine the shape of the holding handle of the spoon, and an interior cutting line (2) which defines the cutting line, the use of the tool, in this case a soup or tea spoon. A spoon bend (3) passes along the edge of the interior cutting line spacially and defines a space (5) for the edge line, which will later form the foot or nodule of the spoon. The cutting lines define an exterior surface (6) which will be used as a handle and an interior surface (7) to be used as the part used for eating.

FIG. 5 describes in side view the spoon according to the invention, received after bending the interior surface (7) approximately in 180° in relation to the exterior surface (6). Between the two surfaces, protruding downwards, is a surface (5) in the space between the bending line (3) and the original edge of the board (4). The center of the spoon leans towards the handle, thus the surface of the handle (6) sinks towards the table, and its edge (8) touches the surface of the table. On the other hand the interior surface (7), whose edge (9) is used for eating, rises upwards when the spoon is placed on the table. The area in use (9) of the spoon can be shaped later in the shape of a concave in accepted ways.

FIG. 6 describes in over view the spoon described in FIG. 5 (in side view). The interior surface was folded outwards and created an air space designed in shape (spoon shape) (10), surrounded by an exterior handle surface (6). Perpendicular to the two surfaces (6) and (7), protruding downwards, is the supporting foot (or nodule) of the spoon, which allows the surface to be used for eating (insertion into the mouth) to be over the table surface when placing the spoon on the table.

FIG. 7 describes in over view the cuting and bending lines in the example of a knife, on the material from which the knife is made. The surface of the material, can be any material accepted in the cutlery industry such as metal or nirosta. The cutting lines are an exterior cutting line (1) which will determine the shape of the holding handle, and the interior cutting line (2) which will define the use of the tool. The exterior cutting line can be designed in any required shape for a handle, aesthetically as well as functionally. The interior cutting line is designed according to the purpose (the shape of the knife blade, the fork prongs, and eliptical or round shape of the soup or tea spoon, etc.). The bending line (3) passes along the edge of the interior cutting line spacially, and defines a space for the line of the edge of the board (4). The surface created in the space (5) between the bending line (the interior cutting line (3)) and the edge of the board (4) will create the supporting foot or nodule of the knife.

FIG. 8 describes in side view the knife according to the invention received after bending of the interior surface (7) approximately in 180° in relation to the exterior surface (6). Between the two surfaces, a surface (5) protrudes upwards in the space between the bending line (3) and the original edge of the board (4). The center of the knife leans towards the handle, and thus the surface of the handle (6) sinks toward the table, and its edge (8) touches the surface of the table. On the other hand the interior surface (7), whose edge (9) is used for eating, rises upwards when the knife is placed on the table, the area of use (9) can be bent and designed according to necessity.

FIG. 9 describes in over view the knife described in FIG. 2 (in side view). The interior surface (7) was folded outwards and created an air space designed in its shape (knife shape) (10) surrounded by a surface of the exterior handle (6). Perpendicular to the two surfaces (6) and (7) downwards, protrudes the supporting foot (nodule) of the knife, which allows the surface to be used for eating (inserting into the mouth) to be over the table surface when placing the knife on the table.

FIGS. 10 and 11 describe (in over view and side view respectively) another variation of cutlery according to the present invention.

FIG. 10 describes a spoon in over view wherein two supporting legs are located on the handle margin in its upper part. The two supporting legs (11) and (11*a*) are created as a result of bending (folding the plane downwards bordered by two cuts in an shape (13) and (13*a*), and are located on the handle margin in its upper part.

FIG. 11 describes the spoon of FIG. 10 in side view. The supporting feet (11) enable the part of the spoon (13), that comes in contact with the food, to be raised when placing the spoon on any surface (14).

FIG. 12 and 13 describe (in over view and side view respectively) another variation of cutlery according to the present invention.

FIG. 12 describes a spoon in over view, wherein the supporting leg (15) is located at the center of the spoon width in its upper part. The support leg if formed as a result of bending the plane downwards, bordered by the shaped cut (16) and is situated in the center of the handle width in its upper part.

FIG. 13 describes in side view (cross section) the spoon in FIG. 12. The supporting foot (15) enable the part that comes in contact with the food (13) to be raised when placing the spoon on any surface (14).

Although FIGS. 10–13 relate to a spoon, the invention relates similarity to the description of any other cutlery such as a knife or fork.

The present invention relates also to a method of production of the supporting legs, described in FIGS. 10–13. The method is comprised of creating two ⌈ shaped cuts in the margin of the handles upper part or on ⌈ shaped cut in the center of the upper part of the handle width and a bending (folding) downwards of the plane received in the area of the cut in order to receive the supporting leg.

I claim:

1. A piece of cutlery comprising:

a handle;

a utensil portion integral with the handle; and a support integral with the handle as a one-piece construction, the support includes a folded cut-out of the handle extending downwardly relative to the handle, the support being positioned to raise the utensil portion and prevent contact thereof with a surface upon which the handle and the support are placed.

2. The piece of cutlery according to claim 1, wherein the utensil portion is one of a fork, spoon or knife.

3. The piece of cutlery according to claim 1, wherein the handle, the utensil portion, and the support are of unitary construction formed from a common piece of raw material.

4. The piece of cutlery according to claim 1, wherein the cut-out extends downwardly at an acute angle relative to the utensil portion so that a lower end of the support contacts the surface at a location between the utensil portion and the surface.

5. A piece of cutlery comprising:

a handle;

a utensil portion; and a support, including a folded cut-out of the handle extending downwardly relative to the handle, disposed at an acute angle relative to the handle so that a lower end of the support contacts the surface at a location between the handle and the surface;

wherein the handle, the utensil portion, and the support are of unitary construction formed from a single piece of material; and the support being positioned to raise the utensil portion and prevent contact thereof with a surface upon which the handle and the support are placed.

6. The piece of cutlery according to claim 5, wherein the utensil portion is one of a fork, spoon or knife.

7. A method of manufacturing a piece of cutlery including a handle, a utensil portion and a support disposed between the handle and the utensil portion, the utensil portion comprising one of a fork, spoon, or knife, the method comprising the steps of:

profiling a sheet of raw material generally in the shape of the handle of the cutlery, making an interior cut in the profiled sheet to form an interior part, the interior part being in the shape of the utensil portion, the interior cut extending slightly less than the length of the profiled sheet to leave an exterior band at an end of the profiled sheet, folding the interior part away from the profiled sheet in the vicinity of the exterior band to an angle in the range of approximately 140° to approximately 180° to create a hollow handle from the profiled sheet and the support from the exterior band, the interior part forming the utensil portion.

8. The method of claim 7, further comprising the step of folding the exterior band away from the profiled sheet so that the exterior band is disposed at an acute angle relative to the utensil portion.

* * * * *